United States Patent [19]

Cromwell

[11] 4,133,078

[45] Jan. 9, 1979

[54] BIVALVE OPENER

[76] Inventor: Kenneth C. Cromwell, 155 Charlesgate Cir., E. Amherst, N.Y. 14051

[21] Appl. No.: 748,149

[22] Filed: Dec. 6, 1976

[51] Int. Cl.[2] ..... A47G 21/06

[52] U.S. Cl. ..... 17/75; 17/76

[58] Field of Search ..... 17/74, 75, 76

[56] References Cited

U.S. PATENT DOCUMENTS

| | | | |
|---|---|---|---|
| 115,474 | 5/1871 | Holtzmann | 17/74 |
| 332,403 | 12/1885 | Leduc | 17/76 |
| 708,014 | 9/1902 | Blagden | 17/75 |
| 1,071,352 | 8/1913 | Schmidt | 17/76 |
| 2,609,565 | 9/1952 | Mostowicz | 17/76 |
| 2,747,220 | 5/1956 | Thompson | 17/76 |
| 3,706,114 | 12/1972 | Waechter | 17/75 |
| 3,846,908 | 11/1974 | Allievi | 17/75 X |
| 3,991,466 | 11/1976 | Smith | 17/75 |

FOREIGN PATENT DOCUMENTS

| | | | |
|---|---|---|---|
| 1424564 | 1965 | France | 17/74 |
| 12651 of | 1849 | United Kingdom | 17/75 |
| 3358 of | 1894 | United Kingdom | 17/75 |

*Primary Examiner*—Russell R. Kinsey
*Assistant Examiner*—Paul J. Hirsch
*Attorney, Agent, or Firm*—Ashlan F. Harlan, Jr.

[57] ABSTRACT

An opener for bivalves, such as clams and oysters, which comprises a holder for a bivalve, an opening blade, having a handle, for insertion between the bivalve shells, said blade being pivotally mounted by a ball joint to allow motion in a vertical plane and rotation about its longitudinal axis, and a spatula-like, flattened spoon for detaching the bivalve from its shells.

3 Claims, 6 Drawing Figures

Fig. 1.
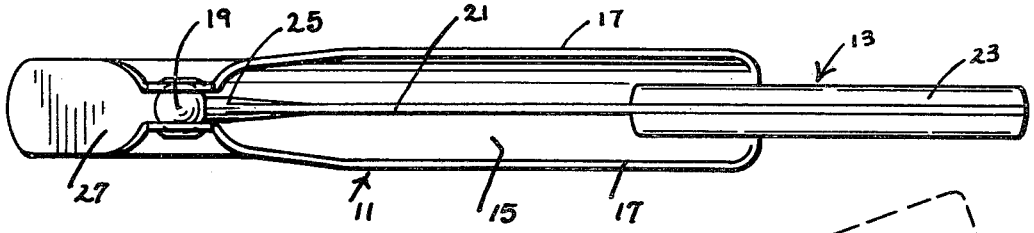
Fig. 2.
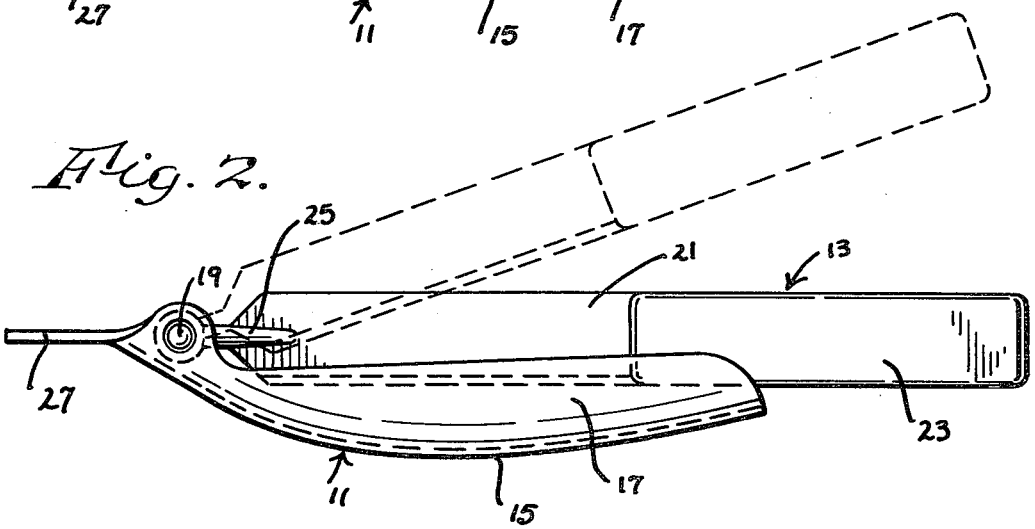
Fig. 3.
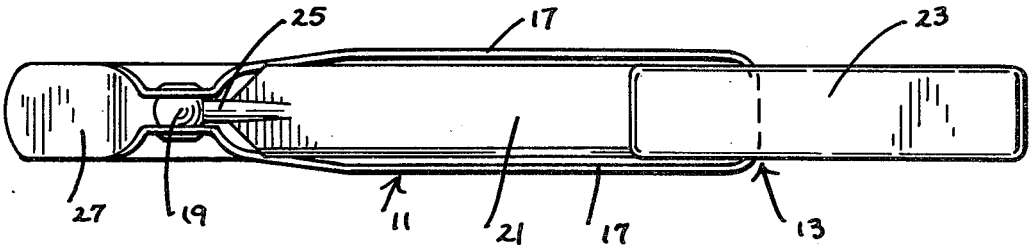
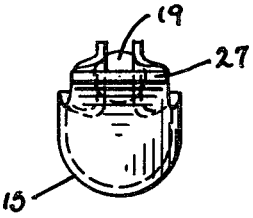
Fig. 4.
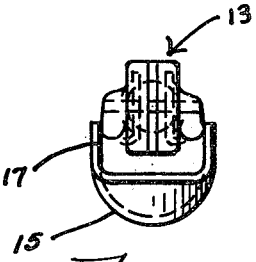
Fig. 5.
Fig. 6.
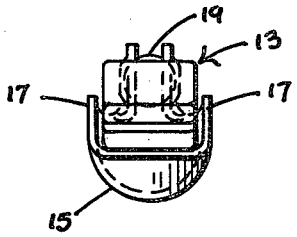

BIVALVE OPENER

BACKGROUND OF THE INVENTION

This invention relates to devices for conveniently opening shellfish, particularly bivalve mollusks such as clams and oysters. As those with experience are aware, it is necessary in opening a bivalve to hold the object steady and firmly while prying apart the two shells, preparatory to severing the muscles attached to the interiors of the shells. In many cases, it is necessary to exert considerable force and, since in many cases the shells are slippery, holding them steady by hand is frequently difficult. Failure to do so, however, may result in injury because usually a relatively sharp instrument is employed in prying the shells apart and any slipping can result in cutting of the hand of the person holding the shells. Further, it is often difficult to exert the force necessary to pry the shells apart while manually opening the shells.

SUMMARY OF THE INVENTION

The bivalve opener of the present invention overcomes these difficulties. It comprises a holder for the bivalve; an opening blade, having a handle, for insertion between the bivalve shells; and a pivotal, ball joint mounting for the blade to permit twisting the blade to pry the shells apart. At one end of the holder there is provided a flattened spoon for detaching the bivalve from the shells after the latter are separated. The entire device is preferably of metal for strength and ease of cleaning.

SHORT DESCRIPTION OF THE DRAWINGS

FIG. 1 is a top view of the opener of the present invention, with the blade in position for insertion between the shells of a bivalve;

FIG. 2 is a side view of the opener shown in FIG. 1, the broken line construction illustrating a raised position of the opening blade;

FIG. 3 is a top view, similar to FIG. 1, showing the blade turned to permit easy grasping of the device after the shells are separated;

FIG. 4 is an end view of the device as shown in FIG. 3 as viewed from the left-hand end thereof;

FIG. 5 is an end view of the device as seen from the right-hand end of FIG. 2; and FIG. 6 is an end view of the device as seen from the right-hand end of FIG. 3.

DESCRIPTION OF THE INVENTION

The terms "upper," "lower," "top," "bottom," "right," "left," "above," "below," "vertical" and "horizontal," and similar terms of position and/or direction as used hereinafter refer to the illustrations in the drawings, but are used only for convenience in description and/or reference. Such terms should not be so construed as to imply a necessary positioning of the structure or portions thereof or as to limit the scope of this invention.

The bivalve opener of the present invention comprises a body or holder for the bivalve, which is comprehensively designated 11, and an opening member or knife 13 movably attached thereto. The holder 11 is preferably integral and includes an elongated portion 15, the sides 17 of which are generally parallel and curved upwardly and the bottom of which is curved longitudinally. Adjacent one end of portion 15, the sides 17 are formed with indented portions each of which is provided with an aperture. The two apertures are transversely aligned and, between them, receive and support a ball 19, thus forming a ball joint in which the ball may be moved freely, but is securely retained.

The knife or opening member 13 comprises a blade 21 and a handle 23 attached thereto at one end. At its other end the blade 21 is firmly attached to the ball 19. As shown, the end of the blade is welded in a longitudinal slot in a pin 25 that is welded to the ball 19. Thus the opening member 13 can be freely raised or lowered or be rotated about its longitudinal axis; or both movements can take place simultaneously. If desired, the knife and the ball may be connected in different fashion. Thus, the knife and pin can be connected by rivetting and the pin can be formed integrally with the ball, the pin and knife may be formed integrally and welded to the ball, or all three elements can be formed integrally. The knife blade 21 is preferably of relatively stiff, rigid construction and one edge 22 thereof is bevelled to facilitate inserting it between the bivalve shells.

The end of the holder or body 11 adjacent to the ball 19 is formed as a short spatula-like, flattened spoon 27 adapted for detaching the bivalve from its shells after the latter are separated.

The bivalve opener of the present invention is easy and convenient to use. In opening a clam, for example, the knife handle 23 is raised, as indicated in broken lines in FIG. 2, the shells containing the clam are placed on edge in the elongated, channeled portion 15 of the holder 11 and the bevelled edge 22 of knife blade 21 is placed on the line where the two shells meet. Pressure is exerted on the knife handle 23 to force the blade between the shells and then the knife is given a twist about its longitudinal axis to pry the shells apart. The opened clam is then removed from the holder 11 and the flattened spoon 27 on the end of the holder 11 may be employed to sever the muscles attaching the clam to the inner sides of the shells so that the clam may be completely removed from the shells or may be served on one of the shell halves from which it may be easily removed with a fork. It will be evident that other bivalves, for example oysters, may be opened in substantially the same way as described above.

It will be seen that the present opener has many advantages. In the first place, it protects the hands of the person opening the bivalve since the latter is held in the body 11 rather than in the hand and the knife is restrained by the ball joint at one end so that it cannot slip and cut the user's hand. In the second place, if desired, the body of the opener can be rested on a support such as a table instead of being held in the hand of the user, thus permitting application of greater force. In such case, the holder may, if desired, be formed with a flat bottom, instead of a curved one. Thirdly, the knife, when turned 90°, as shown in FIG. 3, has the blade protected by the sides 17 of the elongated holder portion 15. Thus when grasping the device for removal of bivalves from their shells with the portion 27 there is no danger of cutting the hand of the user. It will be noted that the longitudinal curve of the holder 11, best shown in FIG. 2, makes it easy to grasp the device. In addition, it will be noted that there is only one moving part in the device and that all parts thereof can be formed of a corrosion-resistant metal, such as stainless steel, thus making it easy to maintain the device in sanitary condition. If desired, however, the knife handle 23 may comprise suitable wood or plastic gripping members on the sides thereof instead of metal ones.

It will be evident that bivalves of a wide range of sizes may be accommodated in the holder 11. However, if desired, the openers may be constructed in various sizes and other variations in construction besides those specifically mentioned above may be made without departing from the spirit of the present invention. Accordingly, it is intended that the invention shall not be considered as limited to the precise structure described and illustrated, but should be construed as broadly as permitted by the accompanying claims.

I claim:

1. An opener for bivalves which comprises: a body and a knife carried by said body; said body having a pair of parallel spaced upstanding ears and a channelled portion extending longitudinally from said ears for a major portion of the length of said body, said channelled portion having sides which are generally parallel and curved upwardly and a closed bottom which is curved longitudinally whereby to be easily and conveniently gripped by the hand of a user and serve to hold a bivalve on edge; said knife being adapted to separate the shells of a bivalve thus held and being pivotally carried at one end thereof on said ears for movement in a vertical arc and also for rotation about its longitudinal axis; said body also having a spatula-like, flat portion extending longitudinally from said ears opposite said channelled portion, said spatula-like portion being substantially in a plane normal to the planes of said ears, having no sharp edges, and having a rounded face end; and said channelled portion further being adapted to enclose the major portions of the edges of said knife when the latter is so rotated that the blade thereof is parallel to said spatula-like portion.

2. An opener for bivalves as defined in claim 1 wherein said spatula-like portion is formed in one piece with said channelled portion and said ears.

3. An opener for bivalves as defined in claim 1 wherein said knife is pivotally mounted by a ball joint.

* * * * *